US008408667B2

(12) United States Patent
Shimizu

(10) Patent No.: US 8,408,667 B2
(45) Date of Patent: Apr. 2, 2013

(54) LIQUID EJECTION HEAD AND RECORDING APPARATUS HAVING THE SAME

(75) Inventor: Yoichiro Shimizu, Kazugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 96 days.

(21) Appl. No.: 13/177,508

(22) Filed: Jul. 6, 2011

(65) Prior Publication Data

US 2012/0026262 A1 Feb. 2, 2012

(30) Foreign Application Priority Data

Jul. 7, 2010 (JP) ..... 2010-154949

(51) Int. Cl.
*B41J 29/38* (2006.01)
*B41J 2/05* (2006.01)
*B41J 2/175* (2006.01)

(52) U.S. Cl. ..... 347/6; 347/66; 347/93

(58) Field of Classification Search ..... 347/6, 65, 347/66, 89, 92, 93
See application file for complete search history.

(56) References Cited

U.S. PATENT DOCUMENTS

| | | | | |
|---|---|---|---|---|
| 7,971,982 | B2 * | 7/2011 | Suzuki | 347/89 |
| 8,167,398 | B2 * | 5/2012 | Suzuki | 347/17 |
| 2005/0157104 | A1 | 7/2005 | Hirota et al. | |
| 2008/0239040 | A1 | 10/2008 | Umeda | |

FOREIGN PATENT DOCUMENTS

| | | | |
|---|---|---|---|
| JP | 2004-351664 | A | 12/2004 |
| JP | 2005-169839 | A | 6/2005 |
| JP | 2006-159432 | A | 6/2006 |
| JP | 2007-203641 | A | 8/2007 |
| JP | 2008-238584 | A | 10/2008 |

* cited by examiner

*Primary Examiner* — Anh T. N. Vo
(74) *Attorney, Agent, or Firm* — Baker Botts L.L.P.

(57) ABSTRACT

A liquid ejection head includes: an ejection port; a supply section and a discharge section; a main flow channel; a supply flow channel; a filter; and a sub flow channel, one end of which is connected to a first connection position near the supply section, and the other end of which is connected to a second connection position near the discharge section, wherein the main flow channel and the sub flow channel are formed such that, in supplying the liquid from the supply section to the main flow channel at a predetermined flow rate, the higher the predetermined flow rate is, the more the ratio of a flow rate in the main flow channel from the first connection position to the second connection position to a flow rate in the sub flow channel increases.

7 Claims, 9 Drawing Sheets

LIQUID EJECTION HEAD AND RECORDING APPARATUS HAVING THE SAME

CROSS REFERENCE TO RELATED APPLICATION

The present application claims priority from Japanese Patent Application No. 2010-154949, which was filed on Jul. 7, 2010, the disclosure of which is herein incorporated by reference in its entirety.

TECHNICAL FIELD

The present invention relates to a liquid ejection head having ejection ports ejecting a liquid, and a recording apparatus having the liquid ejection head.

BACKGROUND

A recording head disclosed in Patent Document 1 has an ink flow channel. The ink flow channel includes a flow channel which supplies ink to ejection ports ejecting ink and a flow channel which discharges ink from the flow channel outside the recording head. In the related art, a technique is known in which a filter is provided in a flow channel of the head to filter a liquid, such as ink. When the above-described filter is provided in the flow channel of the head, the head is configured as described in Patent Document 2 so as to remove bubbles remaining in the filter. A liquid flows from the supply side of the flow channel provided in the head to the discharge side, such that bubbles remaining in the filter are removed.

[Patent Document 1] JP-A-2007-203641

[Patent Document 2] JP-A-2004-351664

SUMMARY

In order to adjust the flow rate of the liquid flowing toward the ejection ports, a sub flow channel is provided separately from a main flow channel, in which the liquid is directed from the supply side of the flow channel to the discharge side, such that the liquid bypasses the supply side and the discharge side of the main flow channel. This is because, if the flow rate of the liquid toward the ejection ports is high, a meniscus formed in the ejection ports may be broken, and the liquid may be unnecessarily ejected from the ejection ports.

In this configuration, if the viscosity of the liquid decreases due to variations in the environmental conditions outside the head, or the like, a high flow rate is required to sweep out bubbles in the main flow channel. Meanwhile, if the flow rate of the liquid which is supplied to the head increases, the flow rate of the liquid in the main flow channel increases, and the flow rate in the sub flow channel also increases. For this reason, the flow rate in the main flow channel insufficiently increases, such that the ability to sweep out bubbles from the filter may be insufficiently exhibited.

An object of the invention is to provide a liquid ejection head which easily secures the ability to sweep out bubbles from a filter in accordance with variations in the environmental conditions, and a recording apparatus having the liquid ejection head.

According to an aspect of the invention, there is provided a liquid ejection head comprising: an ejection port for ejecting a liquid; a supply section and a discharge section for the liquid; a main flow channel which connects the supply section and the discharge section; a supply flow channel which branches off from the main flow channel and supplies the liquid to the ejection port; a filter which is disposed in the vicinity of a branch position in which the supply flow channel is branched from the main flow channel; and a sub flow channel, one end of which is connected to a first connection position closer to the supply section rather than the branch position in the main flow channel, and the other end of which is connected to a second connection position closer to the discharge section rather than the branch position in the main flow channel, wherein the main flow channel and the sub flow channel are formed such that, in supplying the liquid from the supply section to the main flow channel at a predetermined flow rate, the higher the predetermined flow rate is, the more the ratio of a flow rate in the main flow channel from the first connection position to the second connection position to a flow rate in the sub flow channel increases.

According to another aspect of the invention, there is provided a recording apparatus comprising: the liquid ejection head described above; a liquid supply unit which supplies a liquid from the supply section to the main flow channel; a return flow channel which returns the liquid from the discharge section to the liquid supply unit; and a valve which switches a state where the liquid flows through the return flow channel and a state where the liquid does not flow through the return flow channel.

With the liquid ejection head and the recording apparatus according to the aspects of the invention, the main flow channel and the sub flow channel are formed such that, when the flow rate of the liquid which is supplied from the supply section to the head increases, the ratio of the flow rate in the main flow channel to the flow rate in the sub flow channel increases. For this reason, if the flow rate of the liquid which is supplied from the supply section to the head increases, the liquid easily flows into the main flow channel rather than the sub flow channel. Therefore, when the flow rate of the entire liquid which is supplied to the head increases because the viscosity of the liquid decreases, or the like, it is easy to secure the ability to sweep out bubbles remaining in the filters.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Hereinafter, a preferred embodiment of the invention will be described with reference to the drawings.

Figure 1:
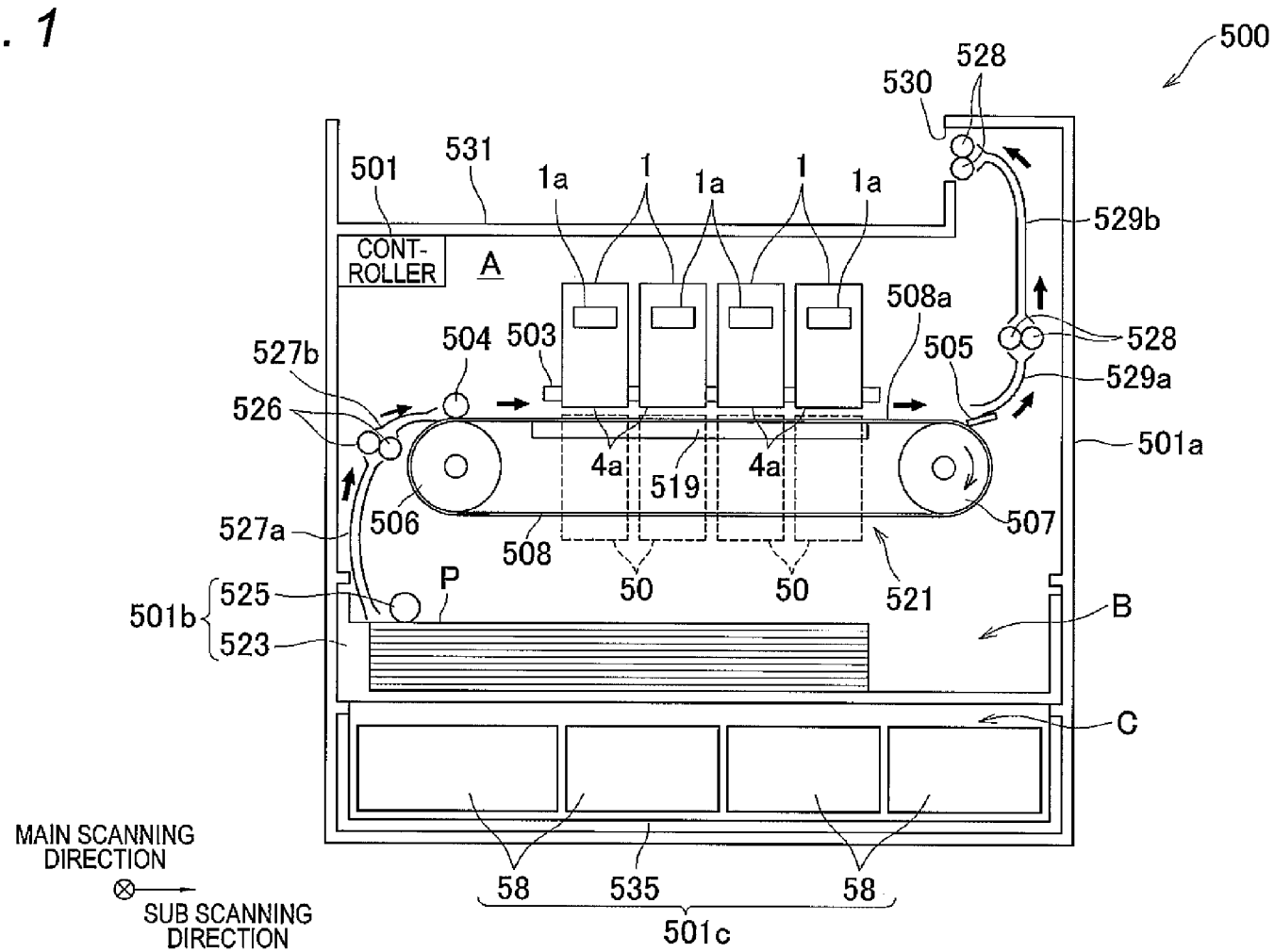
FIG. 1 is a schematic side view showing the internal structure of an ink jet printer according to an embodiment of the invention.

First, the overall configuration of an ink jet printer according to an embodiment of the invention will be described with reference to FIG. 1. As shown in FIG. 1, ahead 1 (recording head) is a line head which is elongated in one direction (a direction perpendicular to the paper of FIG. 1), and is incorporated into an ink jet printer 500 with the longitudinal direction thereof as a main scanning direction. The printer 500 is a line-type color ink jet printer.

The printer 500 has a rectangular parallelepiped housing 501*a*. A sheet discharge section 531 is provided above the top panel of the housing 501*a*. The internal space of the housing 501*a* can be divided into spaces A, B, and C in order from above. In the space A, conveying of a sheet P and image formation on the sheet P are performed. In the space B, an operation relating to sheet feed is carried out. In the space C, main tanks 58 as an ink supply source are accommodated.

In the space A are provided four heads 1, ink supply units 50 which supply ink to the heads 1, a conveying unit 521 which conveys the sheet P, guide portions which guide the sheet P, and the like. At the upper part of the space A, a controller 501 (supply control means) is arranged to control the operations of the respective sections of the printer 500 to manage the overall operation of the printer 500.

Each head 1 substantially has a rectangular parallelepiped shape which is elongated in the main scanning direction. The four heads 1 are arranged in parallel at a predetermined pitch in the sub scanning direction and supported by the housing 501*a* through a head frame 503. Ink droplets of magenta, cyan, yellow, and black are respectively ejected from the lower surfaces 4*a* (ejection surfaces) of the four heads 1 onto the sheet P. The ink supply units 50 supply ink from the main tanks 58 to the heads 1. A temperature sensor 1*a* is fixed to each of the heads 1, and the detection result of the temperature sensor 1*a* is sent to the controller 501. The specific configuration of the heads 1 and the ink supply units 50 will be described below in detail.

The conveying unit 521 has two belt rollers 506 and 507, an endless conveying belt 508 which is wound around both rollers 506 and 507, a nip roller 504 and a separating plate 505 which are arranged outward of the conveying belt 508, a platen 519 which is arranged inward of the conveying belt 508, and the like. The belt roller 507 is a driving roller and rotates with driving of a conveying motor (not shown) in the clockwise direction of FIG. 1 under the control of the controller 501. With the rotation of the belt roller 507, the conveying belt 508 travels in a direction indicated by an arrow of FIG. 1. The belt roller 506 is a driven roller and rotates in the clockwise direction of FIG. 1 with the traveling of the conveying belt 508. The nip roller 504 is arranged to face the belt roller 506 and presses the sheet P fed from an upstream-side guide portion (described below) against an outer circumferential surface 508*a* of the conveying belt 508. On the outer circumferential surface 508*a*, a weak adhesive silicon layer is formed. The separating plate 505 is arranged to face the belt roller 507, separates the sheet P from the outer circumferential surface 508*a*, and guides the sheet P to a downstream-side guide portion (described below). The platen 519 is arranged to face the four heads 1 and supports the upper loop of the conveying belt 508 from the inner circumferential surface side of the belt. Thus, a predetermined gap suitable for image formation is formed between the outer circumferential surface 508*a* and the ejection surfaces 4*a* of the heads 1.

The guide portions are arranged on both sides of the conveying unit 521 so as to sandwich the conveying unit 521 therebetween. The upstream-side guide portion has two guides 527*a* and 527*b*, and a pair of feed rollers 526. This guide portion connects a sheet feed unit 501*b* (described below) and the conveying unit 521. The downstream-side guide portion has two guides 529*a* and 529*b*, and two pairs of feed rollers 582. This guide portion connects the conveying unit 521 and the sheet discharge section 531.

In the space B, the sheet feed unit 501*b* is arranged. The sheet feed unit 501*b* has a sheet feed tray 523 and a sheet feed roller 525, and the sheet feed tray 523 is provided detachably with respect to the housing 501*a*. The sheet feed tray 523 is a box which is opened upward and stores a plurality of sheets P. The sheet feed roller 525 sends the uppermost sheet P in the sheet feed tray 523 under the control of the controller 501 and feeds the sheet to the upstream-side guide portion.

As described above, in the spaces A and B, a sheet conveying path is formed from the sheet feed unit 501*b* to the sheet discharge section 531 through the conveying unit 521. The controller 501 sends the sheet P from the sheet feed roller 523 on the basis of a recording command. The sheet P is sent to the conveying unit 521 through the upstream-side guide portion. When the sheet P passes through directly below the ejection surfaces 4*a* of the heads 1 in the sub scanning direction, ink droplets are sequentially ejected from the heads 1, and a desired color image is formed on the sheet P. Thereafter, the sheet P is separated from the outer circumferential surface 508*a* by the separating plate 505 and discharged to the upper sheet discharge section 531 through the downstream-side guide portion.

The sub scanning direction is the direction parallel to the conveying direction of the sheet P by the conveying unit 521, and the main scanning direction is the direction perpendicular to the sub scanning direction along the horizontal plane.

In the space C, a tank unit 501*c* is provided detachably with respect to the housing 501*a*. The tank unit 501*c* has a tray 535 and four main tanks 58. The four main tanks 58 correspond to the four heads 1 one-to-one, and are arranged in parallel in the sub scanning direction in the tray 535.

Figure 2:
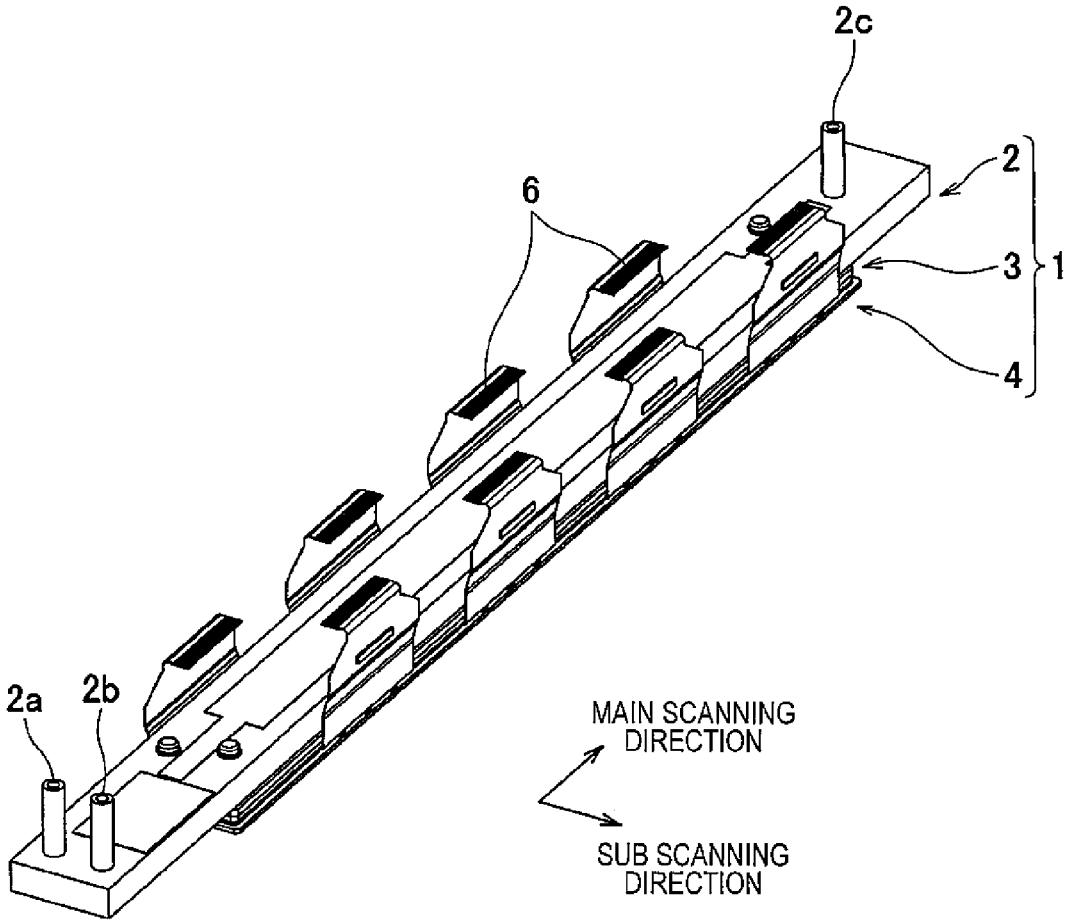
FIG. 2 is a perspective view of an ink jet head of FIG. 1.

Hereinafter, the heads 1 will be described with reference to FIGS. 2 to 6. As shown in FIG. 2, each head 1 substantially has a rectangular parallelepiped shape which is elongated in the main scanning direction. The head 1 includes a laminate in which a filter unit 2, a reservoir unit 3, and a flow channel unit 4 are laminated in order from above. In the upper surface of the filter unit 2, joints 2*a* to 2*c* are formed to protrude upward. Ink is exchanged between the ink supply unit 50 (described below) and the head 1 through the joints 2*a* to 2*c*. Multiple ejection ports 4*y* are formed in the lower surface of the flow channel unit 4, and ink is ejected from the ejection ports 4*y* when forming an image. Inside the laminate, ink flow channels communicate the joints 2*a* to 2*c* and the ejection ports 4*y*. Flexible printed boards 6 are drawn out between the reservoir unit 3 and the flow channel unit 4. The flexible printed boards 6 are connected to actuator units 5 (described below), and supply a driving command from the controller 501 to the actuator units 5.

Figure 3A:
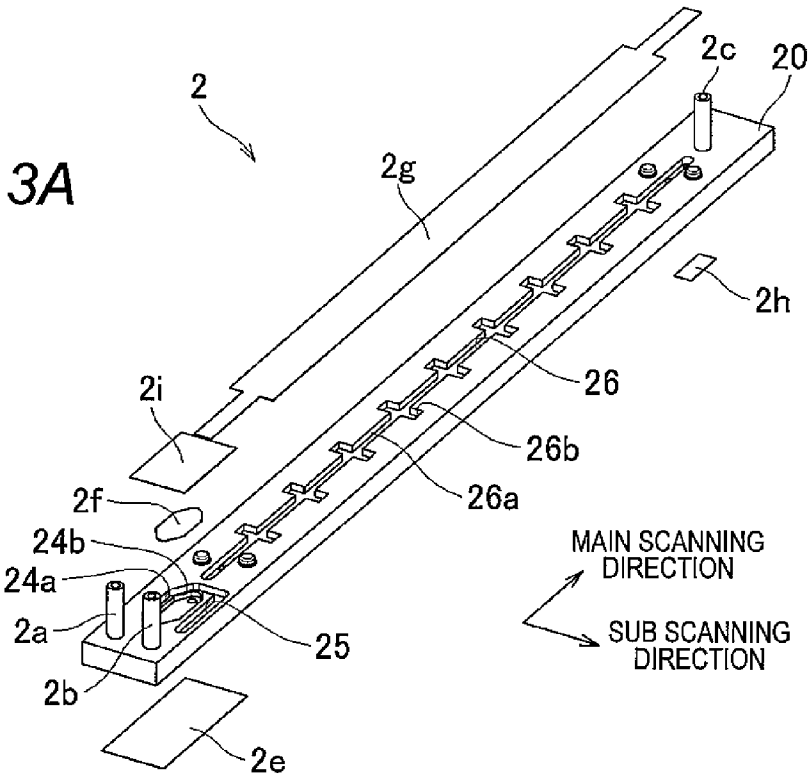
FIG. 3A is an exploded perspective view of a filter unit in the head of FIG. 1.

The filter unit 2 has a unit main body 20 made of a resin material, and performs filtering of ink and adjustment of flow channel resistance. As shown in FIG. 3A, the filter unit 2 is configured such that a filter 2*f* is arranged therein, and a flow channel resistance adjustment section (linear flow channel 26) is formed. The unit main body 20 has the joints 2*a* to 2*c*, and an upper filter chamber 24*a*, a lower filter chamber 24*b*, a communicating flow channel 25, and a linear flow channel 26 which constitute ink flow channels communicating with the joints 2*a* to 2*c*.

Figure 3B:
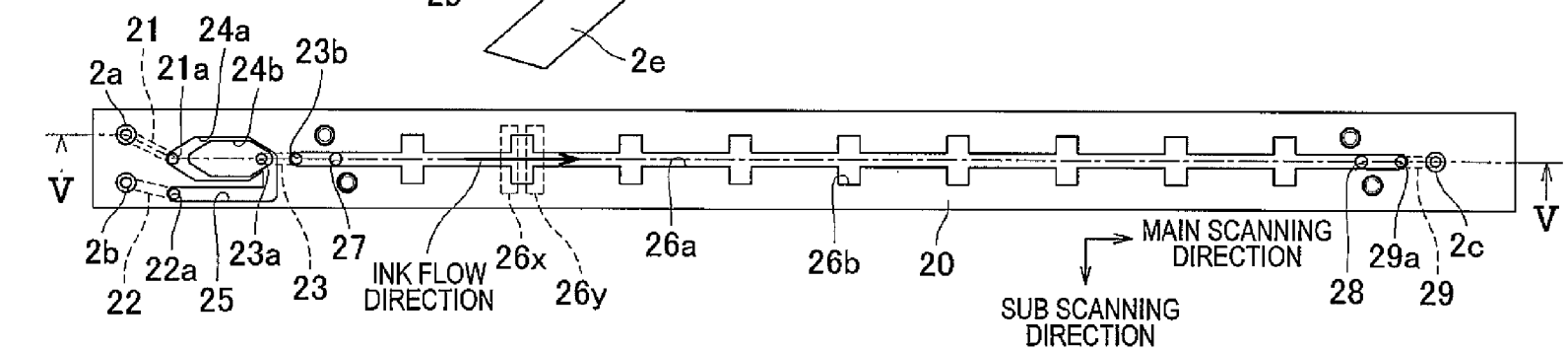
FIG. 3B is a plan view of a unit main body of the filter unit.

As shown in FIG. 3B, the joints 2*a* and 2*b* are arranged in one end portion of the unit main body 20 in the main scanning direction, and the joint 2*c* is arranged in the opposing end position. The upper filter chamber 24*a* is substantially arranged at the center position of the unit main body 20 in the sub scanning direction near the joint 2*a*. The upper filter chamber 24*a* is a concave portion which is opened in the upper surface of the unit main body 20, and schematically has a hexagonal planar shape which is elongated with respect to the main scanning direction. Both ends of the upper filter chamber 24*a* in the main scanning direction are formed to be tapered outward in the main scanning direction. A flexible thin flat plate 2*i* is attached around the upper filter chamber 24*a* from above. The flat plate 2*i* seals the entire opening of the upper filter chamber 24*a* in plan view, and constitutes the upper wall of the upper filter chamber 24*a* (see FIG. 5).

The upper filter chamber 24*a* communicates with the joint 2*a* through a communicating flow channel 21 (discharge flow channel) formed in the unit main body 20. At one end of the upper filter chamber 24*a* near the joint 2*a* in the main scanning direction, a communicating hole 21*a* which is a communicating portion with the communicating flow channel 21 is formed. The communicating hole 21*a* passes through the unit main body 20 vertically. The communicating flow channel 21 is a concave portion (see FIG. 5) which is opened in the lower surface of the unit main body 20. A flexible thin flat plate 2*e* is attached around the communicating flow channel 21 from below. The flat plate 2*e* seals the entire opening of the communicating flow channel 21 in plan view, and constitutes the lower wall of the communicating flow channel 21.

The low filter chamber 24*b* is a concave portion (see FIG. 5) which is opened in the bottom surface of the upper filter chamber 24*a*, and schematically has a planar shape which is substantially similar to the upper filter chamber 24*a*. When viewed in plan view, the lower filter chamber 24*b* is slightly smaller than the upper filter chamber 24*a*. The lower filter chamber 24*b* is separated from the communicating hole 21*a* in the main scanning direction. A filter 2*f* is attached to the communicating portion of the upper filter chamber 24*a* and the lower filter chamber 24*b*. The filter 2*f* covers the entire lower filter chamber 24*b* in plan view, and constitutes a partition wall of the upper filter chamber 24*a* and the lower filter chamber 24*b*. The filter 2*f* transmits ink from the upper filter chamber 24*a* to the lower filter chamber 24*b*, and filters a foreign substance in the ink at that time.

As shown in FIG. 3B, the communicating flow channel 25 is a flow channel which is constituted by the concave portion opened in the upper surface of the unit main body 20, and extends in the sub scanning direction from the end portion opposite to the communicating hole 21*a* in the upper filter chamber 24*a*. The communicating flow channel 25 is bent toward the joint 2*b* near the end portion of the unit main body 20 in the sub scanning direction and then extends in the main scanning direction therefrom to communicate with a communicating flow channel 22 through a communicating hole 22*a* at the distal end in the extension direction. The communicating hole 22*a* passes through the unit main body 20 vertically. The communicating flow channel 25 is covered with the flat plate 2*i* from above, and the upper wall of the communicating flow channel 25 is constituted by the flat plate 2*i*. The communicating flow channel 22 is a concave portion which is opened in the lower surface of the unit main body 20. This opening is covered with the flat plate 2*e* from below, and the lower wall of the communicating flow channel 22 is constituted by the flat plate 2*e*. The communicating flow channel 22 communicates with the joint 2*b*.

The linear flow channel 26 is constituted by a concave portion which is opened in the upper surface of the unit main body 20 (FIGS. 3B and 5), and has a linear portion 26*a* which extends linearly in the main scanning direction and a plurality of expanded portions 26*b* which are expanded on both sides in the sub scanning direction. The linear portion 26*a* is arranged in the central portion of the unit main body 20 in the sub scanning direction, and is formed to have a certain width. The expanded portions 26*b* provided in the linear portion 26*a* all have a rectangular planar shape of the same form and of the same size, and are arranged at regular intervals in the main scanning direction. The expanded portions 26*b* have a rectangular shape in plan view. A flexible thin flat plate 2*g* is attached around the expanded portions 26*b* from above. The flat plate 2*g* covers the entire linear flow channel 26 including the linear portion 26*a* and all the expanded portions 26*b* in plan view, and constitutes the upper wall of the linear flow channel 26.

Figure 5:
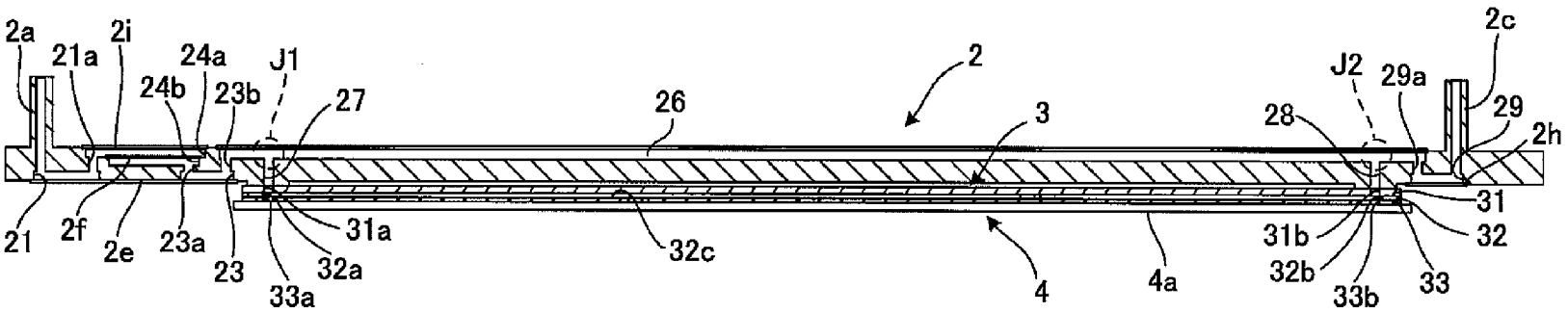
FIG. 5 is a sectional view of the filter unit and the reservoir unit taken along the line V-V of FIG. 3B.

The linear flow channel 26 communicates with an end portion of the lower filter chamber 24*b* on the linear flow channel 26 side through a communicating flow channel 23 in an end portion on the lower filter chamber 24*b* (see FIG. 5). The communicating flow channel 23 is a concave portion which is opened in the lower surface of the main body unit 20, communicates with the lower filter chamber 24*b* through a communicating hole 23*a* at one end, and communicates with the linear flow channel 26 through a communicating hole 23*b* at the other end. The communicating hole 23*a* passes through the bottom wall of the lower filter chamber 24*b*, and the communicating hole 23*b* passes through the unit main body 20 vertically. The communicating flow channel 23 is sealed with the flat plate 2*e* from below, and the lower wall of the communicating flow channel 23 is constituted by the flat plate 2*e*. In the end portion of the linear flow channel 26 on the lower filter chamber 24*b*, a dropping flow channel 27 is connected at a position J1 (first connection position) slightly separated from the communicating hole 23*b* toward the opposing end portion. The dropping flow channel 27 is opened downward in the lower surface of the unit main body 20, and communicates with a through hole 31*a* of the reservoir unit 3 in the opening.

The end portion of the linear flow channel 26 on the joint 2*c* communicates with the joint 2*c* through a communicating flow channel 29 (see FIG. 5). The communicating flow channel 29 is a concave portion which is opened in the lower surface of the unit main body 20, and communicates with the linear flow channel 26 through a communicating hole 29*a*. The communicating hole 29*a* passes through the unit main body 20 vertically. A flexible thin flat plate 2*h* is attached around the communicating flow channel 29 from below. The flat plate 2*h* constitutes the lower wall of the communicating flow channel 29. In the end portion of the linear flow channel 26 on the joint 2*c*, a dropping flow channel 28 is connected at a position J2 (second connection position) slightly separated from the communicating hole 29*a* toward the opposing end portion. The dropping flow channel 28 is opened downward in the lower surface of the unit main body 20, and communicates with a through hole 31*b* of the reservoir unit 3 in the opening.

Figure 4A:
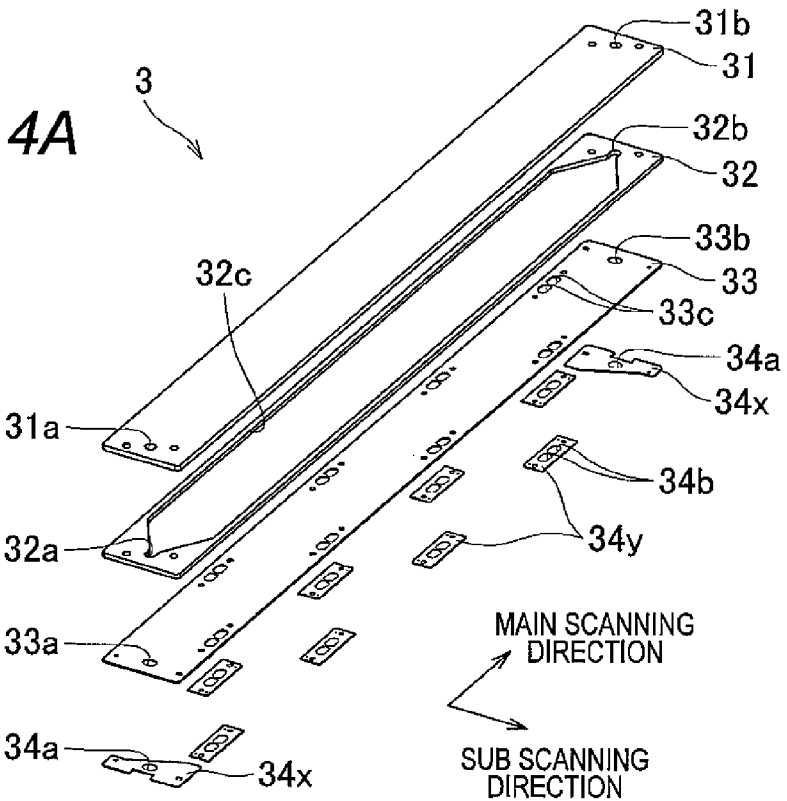
FIG. 4A is an exploded perspective view of a reservoir unit in the head of FIG. 1.

As shown in FIG. 4A, the reservoir unit 3 is a laminate in which flat plate members 31 to 33 having a rectangular planar shape elongated in the main scanning direction, and a plurality of flat plate members 34*x* and 34*y* smaller than the flat plate members 31 to 33 are laminated. Through holes are formed in the flat plate members 31 to 33, 34*x*, and 34*y*, and the through holes communicate with each other to form an ink flow channel.

Figure 4B:
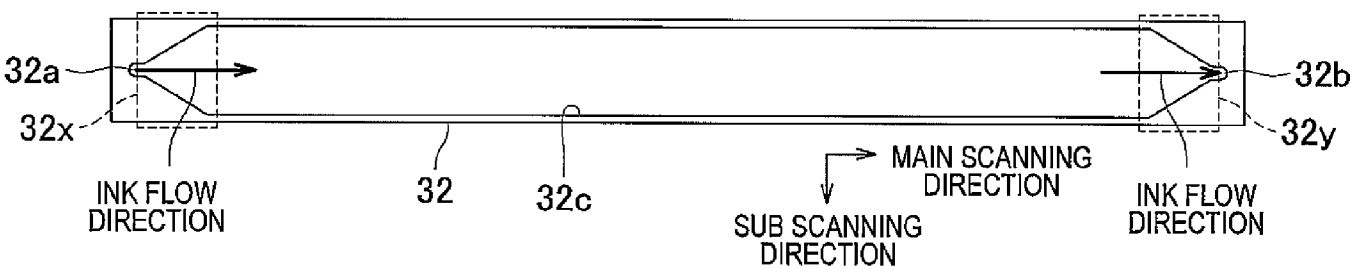
FIG. 4B is a plan view of a reservoir formed in the reservoir unit.

Through holes 31*a* and 31*b* are formed in both end portions of the flat plate member 31 in the main scanning direction. All the through holes 31*a* and 31*b* are arranged at the center of the flat plate member 31 in the sub scanning direction. In the flat plate member 32, through holes 32*a* and 32*b* are formed at the positions facing the through holes 31*a* and 31*b*. A reservoir 32*c* is formed in the main scanning direction between the through hole 32*a* and the through hole 32*b*. The reservoir 32*c* forms a storage space which stores ink in the reservoir unit 3. The reservoir 32*c* is formed such that a portion other than end portions 32*x* and 32*y* substantially has a certain width over the entire width of the flat plate member 32 with respect to the sub scanning direction. As shown in FIG. 4B, the end portions 32*x* and 32*y* are formed to have a tapered shape in which the width gradually decreases toward the through holes 32*a* and 32*b*. The reservoir 32*c* faces a solid region of the flat plate member 31 where no through hole is formed, and the corresponding region of the flat plate member 31 constitutes the upper wall of the reservoir 32*c*.

In the flat plate member 33, as shown in FIG. 4A, dropping flow channels 33*a* and 33*b* are formed at the positions facing the through holes 32*a* and 32*b*. In the end portion of the flat plate member 33 in the sub scanning direction, a plurality of dropping flow channels 33*c* are formed such that every two dripping flow channels are adjacent to each other. The dropping flow channels 33*c* are flow channels which are arranged at the positions facing the reservoir 32*c* to lead ink stored in the reservoir 32*c* downward. The dropping flow channels 33*c* are arranged such that four pairs near one end of the flat plate member 33 and four pairs near the other end are arranged differently from each other in the main scanning direction. The dropping flow channels 33*c* are arranged in a zigzag manner as a whole. A solid region of the flat plate member 33 where no dropping flow channels 33*a* to 33*c* are formed faces the reservoir 32*c* to constitute the lower wall of the reservoir 32*c*.

The flat plate members 34*x* and 34*y* face near the edge of the flat plate member 33. In the flat plate member 34*x*, dropping flow channels 34*a* are formed to face the dropping flow channels 33*a* and 33*b*. The flat plate members 34*x* and 34*y* are arranged at the positions away from the actuator units 5 (described below) in plan view. The flat plate members 34*x* and 34*y* also serve a spacer which forms the installation space of the actuator unit 5 and the flexible printed boards 6 between the reservoir unit 3 and the flow channel unit 4.

Figure 6:
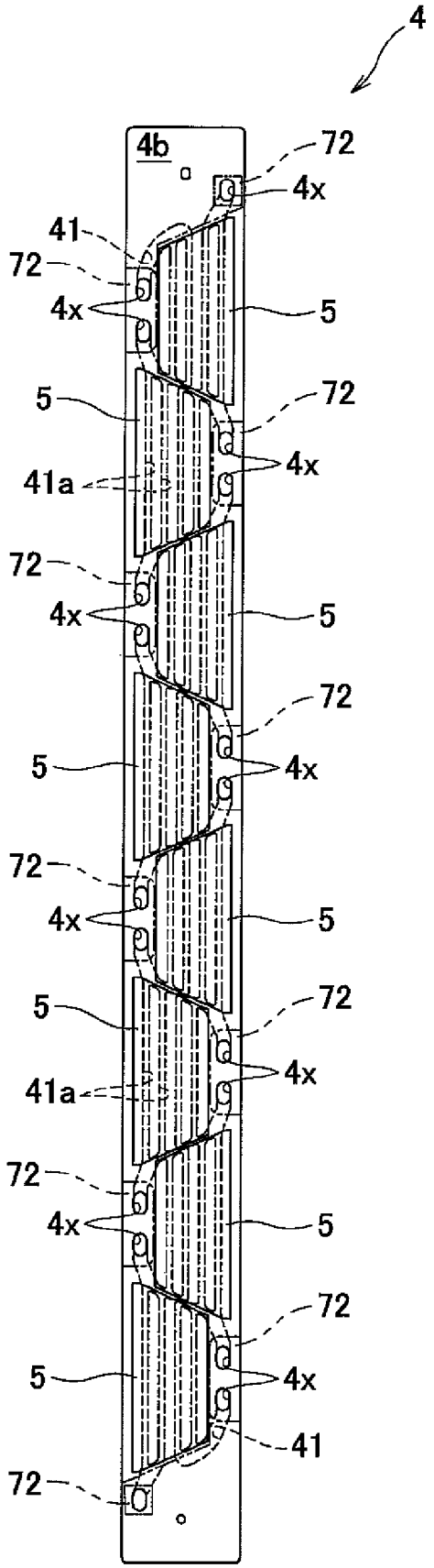
FIG. 6 is a plan view of a flow channel unit in the head of FIG. 1.

As shown in FIG. 6, the flow channel unit 4 is configured such that eight actuator units 5 having a trapezoidal shape are arranged on an upper surface 4*b* in two columns in a zigzag manner. The flexible printed boards 6 are attached to the upper surfaces of the actuator units 5 to supply a driving signal from the controller 501 (see FIG. 2). In the upper surface 4*b*, openings 4*x* are formed to be away from the arrangement regions of the actuator units 5, and are covered with filters 72. The filters 72 are fixed to be sandwiched between the lower surface of the reservoir unit 3 and the upper surface 4*b* of the flow channel unit 4, and communicate the through holes 34*a* and 34*b* with the openings 4*x*. The filters 72 are plate-shaped members arranged with a mesh-shaped material, and filter ink flowing from the reservoir unit 3 into the flow channel unit 4.

The region corresponding to the actuator units 5 in the lower surface 4*a* (see FIG. 5) of the flow channel unit 4 is an ejection region where multiple ejection ports 4*y* are opened. Inside the flow channel unit 4 are formed of a common ink flow channel (manifold flow channel 41 and sub manifold flow channel 41*a*) which communicates with the openings 4*x*, and individual flow channels which extend from the exit of the sub manifold flow channel 41*a* to the ejection ports 4*y*. As shown in FIGS. 4A and 4B, the sub manifold flow channel 41*a* branches off the manifold flow channel 41 and extends in the longitudinal direction of the head.

Figure 7:
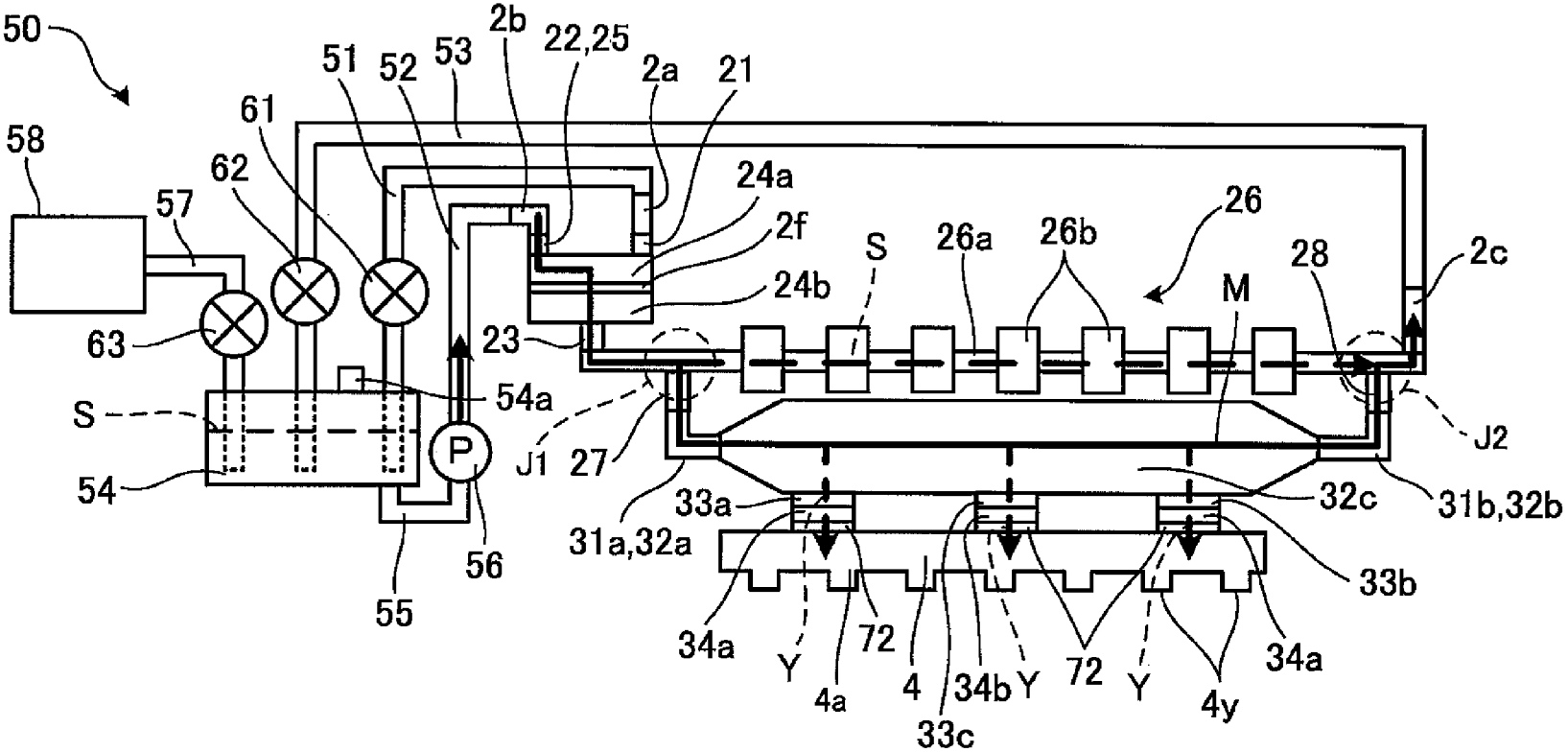
FIG. 7 is a schematic view showing an ink flow channel which is formed over the head and an ink supply unit supplying ink to the head.

With the above-described configuration, in this embodiment, as schematically shown in FIG. 7, a main flow channel M, supply flow channels Y, and a sub flow channel S are formed. The main flow channel M is a flow channel which connects the joint 2*b* (supply section) to the joint 2*c* (discharge section) through the reservoir 32*c*. The supply flow channels Y are flow channels which branch off the reservoir 32*c* and reach the ejection ports 4*y*. The sub flow channel S is a flow channel which mainly bypasses between both ends of the reservoir 32*c*. Specifically, the main flow channel M is connected between the joint 2*b* and the joint 2*c* through the communicating flow channels 22 and 25, the upper filter chamber 24*a*, the filter 2*f*, the lower filter chamber 24*b*, the communicating flow channel 23, the linear flow channel 26, the dropping flow channel 27, the through holes 31*a* and 32*a*, the reservoir 32*c*, the through holes 31*b* and 32*b*, the dropping flow channel 28, and the linear flow channel 26. The supply flow channels Y branch off the main flow channel M in the branch portions of the dropping flow channels 33*a*, 33*b*, and 33*c* from the reservoir 32*c*, and are directed toward the flow channel unit 4 through the filters 72 arranged therearound to supply ink to the ejection ports 4*y*. The sub flow channel S branches off the main flow channel M at the connection position J1 between the linear flow channel 26 and the dropping flow channel 27, is directed toward the connection position J2 to the dropping flow channel 28 along the linear flow channel 26, and is joined with the main flow channel M.

In this way, the sub flow channel S branches off the main flow channel M at the connection position J1 on the joint 2*b* side with respect to the branch positions of the supply flow channels Y from the main flow channel M, and is joined again with the main flow channel M at the connection position J2 on the joint 2*c*. That is, the sub flow channel S serves as a bypass flow channel which bypasses a partial flow channel from the connection position J1 to the connection position J2 in the main flow channel M.

Next, the ink supply unit 50 (liquid supply means) which supply ink to the heads 1 will be described with reference to FIG. 7. The ink supply unit 50 has a sub tank 54 and a pump 56, and supplies ink from the main tank 58 to the head 1 (filter unit 2). The sub tank 54 stores ink therein and opens bubbles in the ink to the air through an air opening hole 54*a*. The sub tank 54 is connected to the joints 2*a* and 2*c* through an elastic tube 51 and an elastic tube 53 (return flow channel), and is also connected to the main tank 58 through an elastic tube 57. The end portions of the elastic tubes 51, 53, and 57 are arranged below the liquid level S of the liquid stored in the sub tank 54. The pump 56 is provided such that the suction side thereof is connected to the sub tank 54 through an elastic tube 55, and the discharge side thereof is connected to the joint 2*b* through an elastic tube 52. The pump 56 is controlled by the controller 501, sucks ink in the sub tank 54 through the elastic tube 55, and supplies the sucked ink to the filter unit 2 through the elastic tube 52 and the joint 2*b*. The pressure which is applied to ink by the pump 56 is controlled by the controller 501. Thus, the flow rate of ink flowing into the head 1 is adjusted.

In the elastic tubes 51, 53, and 57, opening/closing valves 61, 62, and 63 are provided to switch an open state where ink flows through the tubes and a closed state where ink does not flow through the tubes. When the opening/closing valve 61 or 62 is in the open state, a circulation path is formed such that ink flows into the filter unit 2 through the sub tank 54 and the pump 56, and ink flows out of the filter unit 2 to the sub tank 54 through the opening/closing valve 61 or 62 in the open state. With this pump driving, ink in which a foreign substance, such as bubbles or dust, is mixed can be discharged from the filter unit 2 to the sub tank 54. When the pump 56 operates in a state where the opening/closing valve 63 is in the open state, ink is supplied from the main tank 58 to the sub tank 54. The states of the opening/closing valves 61 to 63 are switched under the control of the controller 501.

Next, the flow of ink at the time of recording and purging in the ink jet head 1 will be described with reference to FIG. 7. When recording, the controller 501 puts the opening/closing valves 61 and 63 in the open state and puts the opening/closing valve 62 in the closed state. Thus, with consumption of ink when ink is ejected from the head 1, the flow of ink from the main tank 58 to the filter unit 2 through the sub tank 54 is spontaneously generated. Ink from the sub tank 54 flows into the upper filter chamber 24*a* through the elastic tube 51 and the joint 2*a*. Ink from the upper filter chamber 24*a* flows into the reservoir 32*c* along the main flow channel M, and ink branches off the main flow channel M to the supply flow channels Y and are supplied to the ejection ports 4*y*. Ink passes through two filters of the filters 2*f* and 72 until ink reaches the ejection ports 4*y*, such that a foreign substance in the ink is reliably filtered.

Purging is processing for forcibly discharging ink outside the head 1 to remove a foreign substance, such as bubbles, in the head 1. The purging processing of this embodiment includes (1) circulative purging in which ink is circulated on the upstream side from the filter 2*f*, (2) inter-filter purging in which ink is circulated so as to pass through a flow channel between the filters 2*f* and 72, and (3) nozzle purging in which ink is discharged from the ejection ports 4*y*.

At the time of (1) circulative purging, the controller 501 puts the opening/closing valve 61 in the open state, puts the opening/closing valves 62 and 63 in the closed state, and operates the pump 56. Thus, ink in the sub tank 54 flows from the joint 2*b* into the upper filter chamber 24*a*. In the upper filter chamber 24*a*, ink flows into the communicating flow channel 21 along the upper surface of the filter 2*f*. Accordingly, a foreign substance, such as bubbles, remaining in the upstream-side surface of the filter 2*f* is removed, and clogging of the filter 2*f* is avoided. Ink directed toward the communicating flow channel 21 is discharged from the joint 2*a* to the outside and returns to the sub tank 54 through the elastic tube 51. That is, the joint 2*a* also serves as a discharge section (another discharge section in the invention) which discharges ink from the filter unit 2 to the outside at the time of circulative purging. The flow channel resistance of the flow channel which returns from the upper filter chamber 24*a* to the sub tank 54 through the joint 2*a* is smaller than the flow channel resistance of the flow channel which is directed from the upper filter chamber 24*a* to the ejection ports 4*y* beyond the filter 2*f*. For this reason, during circulative purging, even when the joint 2*b* communicates with the ejection ports 4*y*, there is little possibility that ink will leak from the ejection ports 4*y*.

At the time of (2) inter-filter purging, the controller 501 puts the opening/closing valve 62 in the open state, puts the opening/closing valves 61 and 63 in the closed state, and operates the pump 56. Thus, ink in the sub tank 54 flows from the joint 2*b* into the upper filter chamber 24*a*. In turn, ink is directed toward the joint 2*c* through the reservoir 32*c* along the main flow channel M, and is also directed toward the joint 2*c* along the sub flow channel S which branches off the main flow channel M. Ink discharged from the joint 2*c* returns to the sub tank 54 through the elastic tube 53. Thus, a foreign substance, such as bubbles, in the flow channel between the filter 2*f* and the filter 72 is discharged outside the head 1.

The flow channel resistance of the flow channel which returns to the sub tank 54 through the joint 2*c* along the main flow channel M and the sub flow channel S with the connection position J1 of the linear flow channel 26 and the dropping flow channel 27 as a starting point is smaller than the flow channel resistance of the flow channel which is directed toward the ejection ports 4*y* along the main flow channel M and the supply flow channels Y with the connection point J1 as a starting point. For this reason, during inter-filter purging, even when the joint 2*b* communicates with the ejection ports 4*y*, there is little possibility that ink will leak from the ejection ports 4*y*.

In particular, in this embodiment, in the flow channel from the lower filter chamber 24*b* to the joint 2*c*, the flow channel along the main flow channel M and the sub flow channel S which bypasses the main flow channel M are provided. This contributes to decrease the flow channel resistance of the flow channel from the lower filter chamber 24*b* to the joint 2*c*. Meanwhile, if ink excessively easily flows into the sub flow channel S, it is not possible to secure the flow rate in the main flow channel M, thereby making it impossible to sufficiently remove a foreign substance in the main flow channel M. For this reason, the sub flow channel S is configured to have the flow channel resistance such that, even when the flow channel resistance of the whole of the main flow channel M and the sub flow channel S is lowered, the flow rate in the main flow channel M can be sufficiently secured. For example, the flow channel resistance of the sub flow channel S is adjusted so as to substantially become equal to the flow channel resistance from the connection position J1 to the connection position J2 in the main flow channel M.

At the time of (3) nozzle purging, the controller 501 puts all the opening/closing valves 61 to 63 in the closed state, and operates the pump 56. Thus, ink in the sub tank 54 flows from the joint 2*b* into the upper filter chamber 24*a*. In turn, similarly to the flow of ink at the time of recording, ink reaches the ejection ports 4*y* and is ejected from the ejection ports 4*y*. Therefore, an increase in the viscosity of ink near the ejection ports 4*y* in the flow channel unit 4 or clogging of the ejection ports 4*y* is avoided.

If the temperature of ink changes due to variations in the external environment, the viscosity of ink also varies. If the ink temperature rises and the viscosity of ink decreases, pressure loss due to the viscous property of ink in the main flow channel M or the sub flow channel S is reduced. For this reason, the possibility that ink will leak from the ejection ports 4*y* during circulative purging or inter-filter purging is reduced. On the other hand, if viscosity decreases, the resistance against a foreign substance, such as bubbles, decreases, and the ability to sweep out a foreign substance in the ink flow channel is lowered. Accordingly, when removing a foreign substance through purging, it is necessary to change the flow rate of ink in accordance with the external environment so as to adjust the ability to discharge a foreign substance. For example, if it is determined that the temperature of the head 1 rises on the basis of the detection result of the temperature sensor 1*a*, the controller 501 of this embodiment increases the applied pressure to ink in the pump 56 and increases the flow rate of ink which is supplied to the head 1. A temperature sensor may be configured to directly detect the temperature of ink in the head 1.

However, as in this embodiment, if the sub flow channel S which bypasses the main flow channel M is formed, even when the flow rate of all the ink increases, the flow rate necessary for discharging a foreign substance in the main flow channel M may not be secured because the flow rate of ink flowing in the sub flow channel S as well as the main flow channel M increases.

Accordingly, the sub flow channel S of this embodiment is configured such that, as the flow rate of all the ink flowing in the main flow channel M and the sub flow channel S increases, the ratio of the flow rate of the sub flow channel S to the flow rate of the partial flow channel from the connection position J1 to the connection position J2 in the main flow channel M decreases. At this time, the amount of distribution of ink to the partial flow channel increases.

Specifically, as shown in FIG. 3B, a plurality of expanded portions 26*b* are formed in the linear flow channel 26 which constitutes the sub flow channel S. The expanded portions 26*b* are portions which are expanded from the linear portion 26*a* in the sub scanning direction, and in which a cross-section perpendicular to the extension direction (that is, ink flow direction) of the linear flow channel 26 rapidly changes. In detail, as shown in FIG. 3B, an ink inflow portion 26*x* (first change portion) of each of the expanded portions 26*b* is rapidly expanded along the ink flow direction with respect to the sub scanning direction, and the cross-sectional area thereof substantially discontinuously changes. An ink outflow portion 26*y* (first change portion) of each of the expanded portions 26 rapidly contracts along the ink flow direction with respect to the sub scanning direction, and the cross-sectional area thereof substantially discontinuously changes in the inflow direction. Thus, when ink passes through the ink inflow portion 26*x* and the ink outflow portion 26*y*, the flow velocity of ink changes, and pressure loss due to a change in velocity occurs. If pressure loss due to a change in velocity when ink passes through the ink inflow portion 26*x* is ΔP1, a loss coefficient is ζ1, the density of ink is ρ, and the flow velocity before and after passing is u1 and u2, ΔP1 is expressed as follows. Since the ink inflow portion 26*x* is a portion which is rapidly expanded with respect to the sub scanning direction, ζ1=1.

$$\Delta P1=\zeta 1*\rho*(u1-u2)^2/2 \quad \text{(Expression 1-1)}$$

If pressure loss due to a change in velocity when ink passing through the ink outflow portion 26*y* is ΔP1', a loss coefficient is ζ1', and the flow velocity before and after passing is u1' and u2', ΔP1' is expressed as follows. Since the ink outflow portion 26*y* is a portion which rapidly contracts with respect to the sub scanning direction, ζ1'=1.

$$\Delta P1'=\zeta 1'*\rho*(u1'-u2')^2/2 \quad \text{(Expression 1-2)}$$

A plurality of expanded portions 26*b* having the above-described flow channel characteristic are formed in the sub flow channel S. Pressure loss includes pressure loss due to a change in velocity and pressure loss due to viscosity. Thus, the entire pressure loss $\Delta P1_{ALL}$ in the sub flow channel S is expressed as follows. Σ means that pressure loss is summed for all the expanded portions 26*b*, and Δp1 represents pressure loss due to viscosity.

$$\Delta P1_{ALL}=\Sigma(\Delta P1+\Delta P1')+\Delta p1 \quad \text{(Expression 1-3)}$$

In the main flow channel M, the flow channel shape changes at both end portions 32*x* and 32*y* of the reservoir 32*c*, and this is one of the main factors for a change in velocity in the main flow channel M. In the end portion 32*x*, the cross-section perpendicular to the extension direction of the reservoir 32*c* is gradually expanded with respect to the inflow direction (main scanning direction) of ink flowing in the extension direction of the reservoir 32*c*. In the end portion 32*y*, the cross-section perpendicular to the extension direction of the reservoir 32*c* is gradually reduced with respect to the outflow direction (main scanning direction) of ink flowing in the extension direction of the reservoir 32*c*. If pressure loss due to a change in velocity when ink passes through the end portion 32*x* is ΔP2, a loss coefficient is ζ2, and the flow velocity before and after passing is v1 and v2, ΔP2 is expressed as follows. The end portion 32*x* is a portion (second change portion) which is gradually expanded with respect to the sub scanning direction, and in which the cross-sectional area continuously changes in the ink flow direction. For this reason, 0<ζ2<1.

$$\Delta P2=\zeta 2*\rho*(v1-v2)^2/2 \quad \text{(Expression 2-1)}$$

If pressure loss due to a change in velocity when ink passes through the end portion 32*y* is ΔP2', a loss coefficient is ζ2', and the flow velocity before and after passing is v1' and v2', ΔP2' is expressed as follows. The end portion 32*y* is a portion (second change portion) which is gradually reduced with respect to the sub scanning direction, and in which the cross-sectional area continuously changes in the ink flow direction. For this reason, 0<ζ2'<1.

$$\Delta P2'=\zeta 2'*\rho*(v1'-v2')^2/2 \quad \text{(Expression 2-2)}$$

Thus, the entire pressure loss $\Delta P2_{ALL}$ in the reservoir 32*c* is expressed as follows. Δp2 represents pressure loss due to viscosity.

$$\Delta P2_{ALL}=\Delta P2+\Delta P2'+\Delta p2 \quad \text{(Expression 2-3)}$$

As shown in (Expression 1-1), (Expression 1-2), (Expression 2-1), and (Expression 2-2), while pressure loss ΔP, ΔP1', ΔP2, and ΔP2' due to a change in velocity is proportional to the square of the change in velocity, pressure loss Δp1 and Δp2 due to viscosity depends on the first order of the flow velocity (for example, in the case of a laminar flow in a pipe line with a uniform cross-section, pressure loss Δp1 and Δp2 due to viscosity is proportional to the average flow velocity of ink which cuts across one cross-section of the pipe line). Thus, if the flow rate of ink increases and the flow velocity increases, in (Expression 1-3) and (Expression 2-3), the influence of pressure loss ΔP1, ΔP1', ΔP2, and ΔP2' due to a change in velocity relatively increases compared to pressure loss Δp1 and Δp2 due to viscosity. As described above, the loss coefficients ζ1 and ζ1' are greater than the loss coefficients ζ2 and ζ2'. For this reason, pressure loss ΔP1 and ΔP1' due to a change in velocity in the sub flow channel S undergoes a large degree of change when the flow rate of ink increases compared to pressure loss ΔP2 and ΔP2' due to a change in velocity in the main flow channel M. That is, in the sub flow channel S, pressure loss when the flow rate of ink increases easily increases compared to the main flow channel M. For this reason, as the flow rate of all the ink increases, the ratio of the flow rate of the sub flow channel S to the flow rate of the main flow channel M decreases.

Figure 8A:
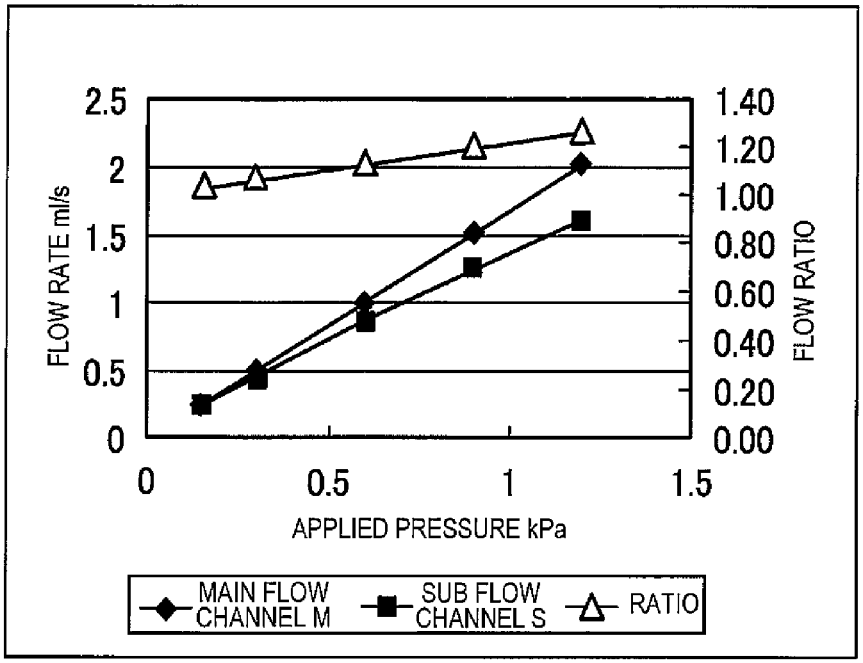
FIGS. 8A and 8B are graphs showing the measurement results of the flow rates of ink which branches into a main flow channel and a sub flow channel formed in the head.

FIG. 8A shows the measurement results of the flow rate [ml/s] of ink branching into the main flow channel M at the connection position J1 and the flow rate [ml/s] of ink branching into the sub flow channel S at the connection position J1 with respect to a pressure [kPa] applied to ink by the pump 56 when inter-filter purging is performed in an example according to the head 1 of this embodiment. FIG. 8A also shows the ratio of the ink flow rates. The measurement results show that, if the flow rate of ink flowing into the head 1 increases, the ratio of the flow rate branching into the sub flow channel S to the flow rate branching into the main flow channel M decreases. This result is because, as described above, $\zeta 1$, $\zeta 1' > \zeta 2$, $\zeta 2'$, such that the degree of increase in pressure loss due to a change in velocity in the sub flow channel S when the flow rate increases is larger than the degree of increase in pressure loss due to a change in velocity in the main flow channel M.

Figure 8B:
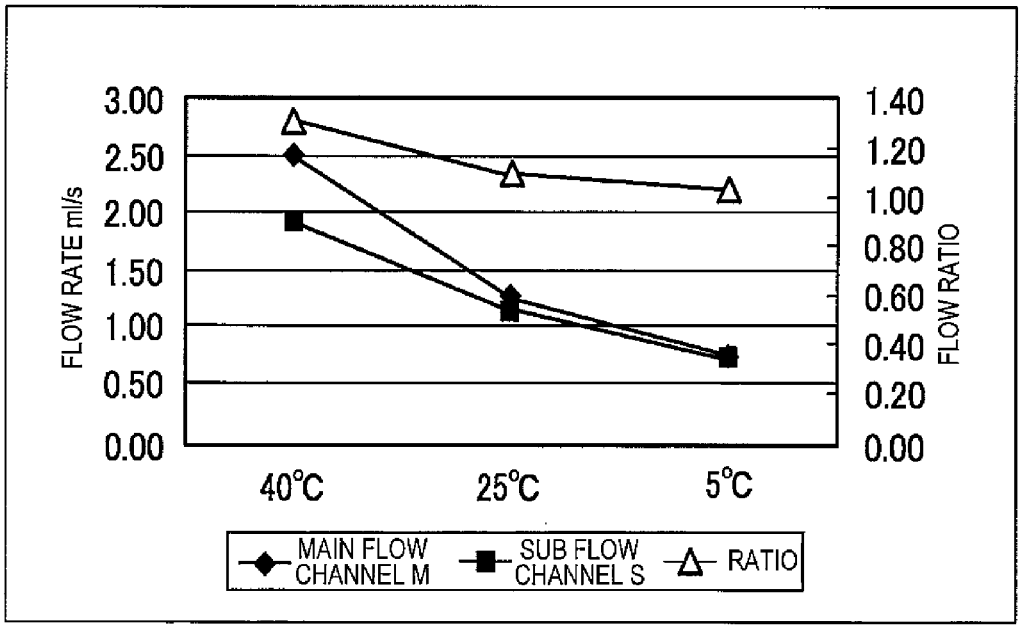

FIG. 8B shows the measurement results of the flow rate [ml/s] of ink branching into the main flow channel M at the connection position J1 and the flow rate [ml/s] of ink branching into the sub flow channel S at the connection position J1 when the temperature condition changes and the flow rate of ink flowing into the head 1 also changes in the example of FIG. 8A. FIG. 8B also shows the ratio of the ink flow rates. FIG. 8B shows that, if the flow rate of ink flowing into the head 1 increases simultaneously with a temperature rise, the ratio of ink branching into the main flow channel M to ink branching into the sub flow channel S increases as might be expected. If the temperature rises, viscosity decreases, such that the influence of pressure loss due to a change in velocity further increases with respect to pressure loss due to viscosity. For example, at the time of inter-nozzle purging, the controller 501 of this embodiment controls the pump 56 to increase the flow rate of ink flowing into the head 1 as shown in FIG. 8B with a temperature rise of the head 1.

According to this embodiment described above, when increasing the flow rate of all the ink, the ratio of the flow rate of the main flow channel M to the flow rate of the sub flow channel S increases. For this reason, if the flow rate of ink flowing from the pump 56 into the head 1 increases, the ratio of ink branching into the main flow channel M to ink branching into the sub flow channel S increases. Accordingly, for example, when the ability to sweep out a foreign substance, which is reduced because the viscosity of ink decreases, is restored by increasing the flow rate of ink, the ratio of ink branching into the main flow channel M with an increase in the flow rate of ink increases, making it easy to secure the ability to sweep out a foreign substance.

When there is no flow channel resistance adjustment function of the sub flow channel S, it is also necessary to increase the flow rate of the sub flow rate S so as to increase the flow rate of the main flow channel M. For this reason, an excessive pressure is applied from the pump to ink. Accordingly, for example, at the time of inter-filter purging, ink leaks from the ejection ports 4*y*. However, in this embodiment, since the sub flow channel S has the flow channel resistance adjustment function, even when an excessive pressure is not applied from the pump to ink, it is possible to increase the flow rate of the main flow channel M. For this reason, a foreign substance is appropriately discharged, and no wasteful ink consumption occurs.

In increasing the flow rate of all the ink, a plurality of expanded portions 26*b* are provided in the sub flow channel S to form a flow channel such that the ratio of the flow rate of the main flow channel M to the flow rate of the sub flow channel S increases. The expanded portions 26*b* are portions in which pressure loss easily increases with a change in the cross-sectional area of the flow channel when the flow rate increases. Specifically, a configuration is made such that the loss coefficient $\zeta 1$ of each of the expanded portions 26*b* becomes greater than the loss coefficient $\zeta 2$ of each of the end portions 32*x* and 32*y* of the main flow channel M. For this reason, when the entire flow rate increases, the flow rate of the main flow channel M easily increases compared to the flow rate of the sub flow channel S.

MODIFICATIONS

Although the preferred embodiment of the invention has been described, the invention is not limited to the above-described embodiment, and various modifications may be made without departing from the scope described in the means for solving the problem.

Figure 9:
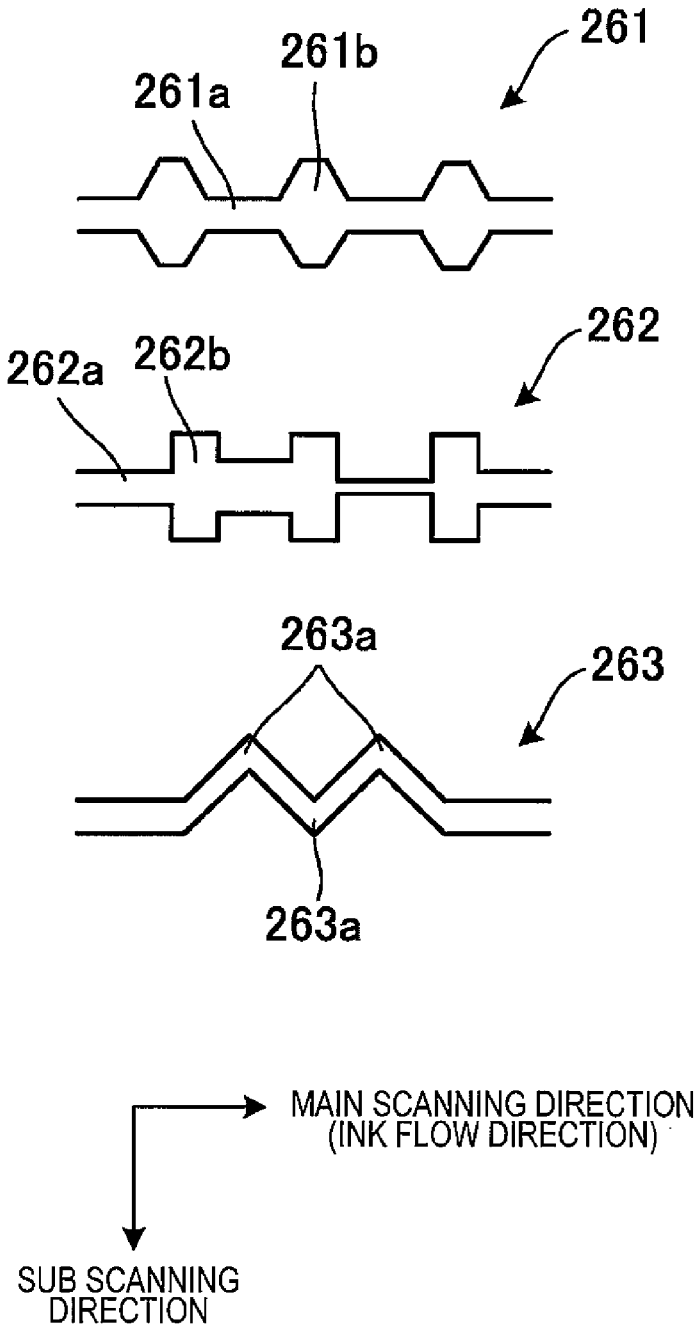
FIG. 9 is a plan view showing modifications of an ink flow channel formed in the head.

For example, FIG. 9 shows linear flow channels 261 and 262 and a bent flow channel 263 according to modifications, instead of the linear flow channel 26 of the above-described embodiment. The linear flow channel 261 has a linear portion 261*a*, and expanded portions 261*b* which are expanded from the linear portion 261*a* in the sub scanning direction. Unlike the expanded portions 26*b*, the expanded portions 261*b* do not have a rectangular planar shape, and are formed such that the inflow portion and the outflow portion thereof are tapered. Preferably, the loss coefficient of each of the expanded portions 261*b* is greater than the loss coefficient in each of the end portions 32*x* and 32*y* of the reservoir 32*c* such that pressure loss increases. The linear flow channel 262 has a linear portion 262*a* and expanded portions 262*b*. Unlike the linear portion 26*a*, the width of the linear portion 262*a* in the sub scanning direction changes. The bent flow channel 263 is formed to have a plurality of bends 263*a* and is configured such that pressure loss increases due to the bends 263*a*. The bent flow channel 263 may be appropriately combined with the linear flow channels 261 and 262.

The ink supply unit 50 may have a configuration other than the above-described embodiment insofar as ink can be introduced from the joint 2*b* and ink can be discharged from the joint 2*a* or 2*c*. For example, a configuration may be made such that ink discharged from the joint 2*b* or 2*c* directly flows into the joint 2*a* without passing through the sub tank 54.

Although in the above-described embodiment, the sub tank 54 and the head 1 constitute a circulative flow channel through the pump 56, at least one of the elastic tube 51 and the elastic tube 53 as the return flow channel from the head 1 to the sub tank 54 may be connected to a portion (for example, a waste liquid tank) other than the sub tank 54. At this time, while part of ink sent by the pump is discarded, the exhaust amount may be small due to the flow channel resistance adjustment function of the sub flow channel S.

Although in the above-described embodiment, the flow channel width in each of the main flow channel M and the sub flow channel S is linearly changed, the flow channel width may change in a different form. For example, the change portion of the flow channel width may change in a curve form.

The above-described embodiment is an example where the invention is applied to an ink jet head which ejects ink from nozzles, and the invention is not limited to the ink jet head. For example, the invention may be applied to a liquid ejection head which ejects conductive paste to form a minute wire pattern on a substrate, ejects an organic luminescent material to a substrate to form a high-definition display, or ejects optical resin to a substrate to form a minute electronic device, such as an optical waveguide.

What is claimed is:

1. A liquid ejection head comprising:

an ejection port for ejecting a liquid;

a supply section and a discharge section for the liquid;

a main flow channel which connects the supply section and the discharge section;

a supply flow channel which branches off from the main flow channel and supplies the liquid to the ejection port;

a filter which is disposed in the vicinity of a branch position in which the supply flow channel is branched from the main flow channel; and a sub flow channel, one end of which is connected to a first connection position closer to the supply section rather than the branch position in the main flow channel, and the other end of which is connected to a second connection position closer to the discharge section rather than the branch position in the main flow channel, wherein the main flow channel and the sub flow channel are formed such that, in supplying the liquid from the supply section to the main flow channel at a predetermined flow rate, the higher the predetermined flow rate is, the more the ratio of a flow rate in the main flow channel from the first connection position to the second connection position to a flow rate in the sub flow channel increases.

2. The liquid ejection head according to claim 1, wherein the sub flow channel has a first change portion in which an area of a cross-section perpendicular to an extension direction of the sub flow channel changes along the extension direction of the sub flow channel.

3. The liquid ejection head according to claim 2, wherein the main flow channel has a second change portion between the first connection portion and the second connection portion in which an area of a cross-section perpendicular to an extension direction of the main flow channel changes along the extension direction of the main flow channel, and the first and second change portions are formed such that ζ1 expressed by Expression 1 becomes greater than ζ2 expressed by Expression 2:

$$\Delta P1=\zeta 1*\rho*(u1-u2)^2/2 \quad \text{(Expression 1)}$$

$$\Delta P2=\zeta 2*\rho*(v1-v2)^2/2 \quad \text{(Expression 2)}$$

In Expressions 1 and 2, ΔP1, u1, and u2 respectively denote pressure loss in the first change portion, the flow velocity of the liquid flowing into the first change portion, and the flow velocity of the liquid flowing out of the first change portion, ΔP2, v1, and v2 respectively denote pressure loss in the second change portion, the flow velocity of the liquid flowing into the second change portion, and the flow velocity of the liquid flowing out of the second change portion, and ρ denotes the density of the liquid.

4. The liquid ejection head according to claim 3, wherein, in a change portion of the first change portion, the area of the cross-section substantially discontinuously changes along the extension direction of the sub flow channel, and in a change portion of the second change portion, the area of the cross-section continuously changes along the extension direction of the main flow channel.

5. The liquid ejection head according to claim 2, wherein a plurality of the first change portions are formed in the sub flow channel.

6. The liquid ejection head according to claim 1, further comprising:

another discharge section different from the discharge section;

another filter, different from the filter, which is arranged at a position closer to the supply section rather than the first connection position in the main flow channel; and a discharge flow channel which branches off a position closer to the supply section rather than the another filter in the main flow channel and communicates with the another discharge section.

7. A recording apparatus comprising:

the liquid ejection head according to claim 1;

a liquid supply unit which supplies a liquid from the supply section to the main flow channel;

a return flow channel which returns the liquid from the discharge section to the liquid supply unit; and a valve which switches a state where the liquid flows through the return flow channel and a state where the liquid does not flow through the return flow channel.

* * * * *